United States Patent [19]

Hartley

[11] 4,297,225

[45] Oct. 27, 1981

[54] RECYCLING CENTRIFUGE FOR THE REDUCTION OF VISCOSITY AND GEL STRENGTH OF DRILLING FLUIDS

[76] Inventor: Bobby G. Hartley, 1011 Iberville St., Donaldsonville, La. 70346

[21] Appl. No.: 932,536

[22] Filed: Aug. 10, 1978

Related U.S. Application Data

[63] Continuation-in-part of Ser. No. 838,388, Sep. 30, 1977, abandoned, which is a continuation-in-part of Ser. No. 755,973, Dec. 30, 1976, abandoned, which is a continuation-in-part of Ser. No. 622,078, Oct. 14, 1975, abandoned.

[51] Int. Cl.[3] ..... B04B 5/00

[52] U.S. Cl. ..... 210/779; 210/788; 210/512.1; 233/19 R

[58] Field of Search ..... 210/1, 19, 78, 811, 210/358, 360 R, 512 R, 520, 541, 542, 779, 788; 233/19 R

[56] References Cited

U.S. PATENT DOCUMENTS

| | | | |
|---|---|---|---|
| 2,422,464 | 6/1947 | Bartholomew | 210/512 R |
| 2,941,783 | 6/1960 | Stinson | 210/512 R |
| 3,126,337 | 3/1964 | Smith | 233/19 R |
| 3,399,773 | 9/1968 | Read | 210/512 R |

*Primary Examiner*—John Adee

*Attorney, Agent, or Firm*—Llewellynn A. Proctor

[57] ABSTRACT

The invention relates to process and apparatus for reducing the viscosity and gel strength of drilling fluids, or muds, without any necessity of introducing additives, or chemicals, into the mud. It embodies, in particular, (i) a process wherein a hydratable clay containing drilling fluid, or mud, is contacted with a revolving, or otherwise moving, surface at an angle of contact sufficient to impart adequate compression or sheer force, or both, to dewater the hydrated clay constituent, or constituents, of said drilling fluid, or mud; and (ii) an apparatus, or inertial device, constituted generally of structure inclusive of a revolvable cone within the inner surface of which a stream or spray of said hydratable clay-containing drilling fluid, or mud, can be impinged or contacted, when the cone is revolved at sufficient speed, to impart adequate compression or sheer force, or both, to dewater the hydrated clay constituent, or constituents, and thereby reduce the viscosity and gel strength of the drilling fluid, or mud.

8 Claims, 2 Drawing Figures

Figures 1, 2:
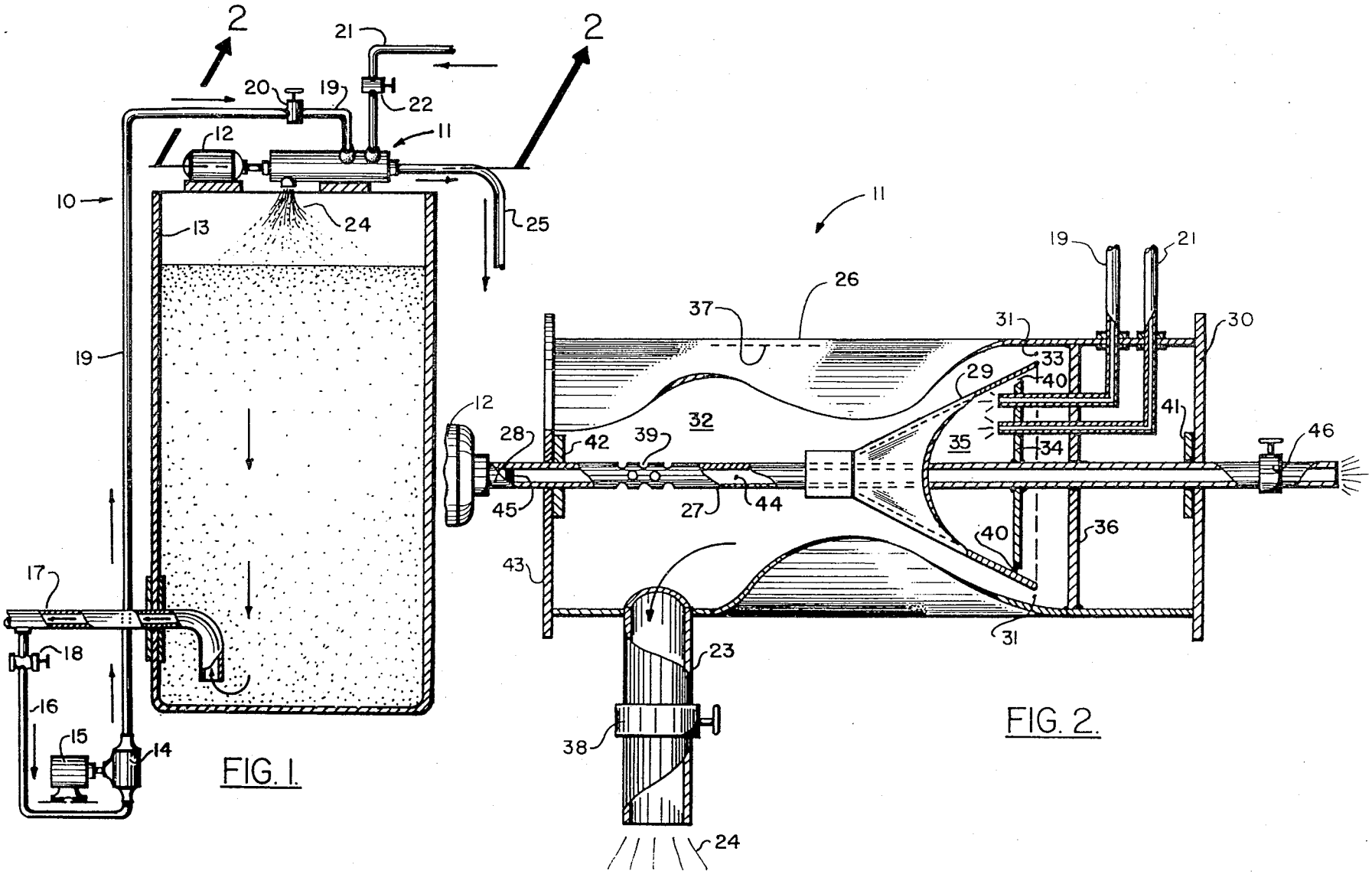

RECYCLING CENTRIFUGE FOR THE REDUCTION OF VISCOSITY AND GEL STRENGTH OF DRILLING FLUIDS

RELATED APPLICATIONS

This is a continuation-in-part of U.S. patent application Ser. No. 838,388, filed Sept. 30, 1977; now abandoned, which in turn is a continuation-in-part of U.S. patent application Ser. No. 755,973, filed Dec. 30, 1976, both by the inventor herein; now abandoned, the latter being in turn a continuation-in-part of U.S. patent application Ser. No. 622,078, filed Oct. 14, 1975, by the inventor herein and George Spector (amended to include only the inventor herein), now abandoned, both entitled "Recycling Centrifuge for Drill Pipe Sludges." All previous disclosures are herein incorporated by reference as part and parcel hereof for purposes of obtaining the benefit of the earlier filing dates.

BACKGROUND OF THE INVENTION

1. Field of the Invention

This invention relates to process and apparatus for restoring the rheological properties of drilling fluids, or muds, constituting slurries of clayey solids, especially to effect reduction of viscosity and gel strength of the mud without the addition of additives, and without significant change in the density of the mud.

Rotary drilling, as practiced in oil and gas production, requires the formation of a hole, or well bore, extending downwardly from the earth's surface to an oil or gas producing stratum. Formation of the well bore requires cutting into the earth with a rotating bit which is attached to the end of a drill string to which joints of pipe are sequentially attached as the well bore is extended downwardly. In the drilling operation, a drilling fluid, or mud, constituted generally of a mixture of weighing materials, clays, chemicals and water or oil is pumped down the drill string, to exit through jets in the drill bit at the bottom of the hole, the fluid, or mud, ascending to the surface via the annular space between the exterior wall of the drill string and the wall of the hole, or well bore. At the surface, the mud is pumped to a shale shaker for cuttings removal, and then returned to a mud pit or temporarily stored in a sump pit.

Drilling muds serve several essential functions, the most important of which are to seal off permeable formations of oil, gas, or water which may be encountered as the well is drilled through different subterranean formations, lubricate and cool the drill bit, lubricate the drill string, remove cuttings from the well and, in the event of a shutdown in the drilling operation, to hold the cuttings, sand and other residual materials in suspension within the static column of drilling mud. The drilling mud contains various materials and weighing agents, including particularly sustantial quantities of clays and other colloidal materials which assist in imparting the required viscosity and gel strength to the mud as required for the entrainment and suspension of the cuttings. The mud also must provide adequate lubrication of the drill bit and drill string, and it must be sufficiently fluid that it can be pumped. The gel characteristics of the mud must be sufficient to seal the formation and suppress fluid losses to the surrounding strata and, by its hydrostatic pressure, it must prevent the escape of gas or oil to prevent blowout of the well. Whereas the specific gravity or density of the mud can be readily increased by the addition of weighing materials, the drilling mud must have the proper viscosity. It must thus be thick enough to carry the cuttings and sand from the hole and suspend the cuttings and sand in the event of a shutdown, but it must also be thin enough to permit ready pumping of the mud, while yet allowing settlement and separation of the cuttings from the mud in the surface mud pits.

An ideal drilling fluid is thixotropic. A mud of this character is one whose apparent viscosity decreases as the degree of agitation or shear rate increases (as is caused by pumping or circulating the mud through the drill string); but when such agitation ceases, the mud gels sufficiently to support the cuttings and sand to prevent their resettlement back into the bottom of the well bore. Clay-based muds having thixotropic properties are used to provide the necessary particle-carrying capacity, viscosities and gel strengths. These muds thus have the property of providing a relatively high viscosity when at rest, but the viscosity is reduced when the mud is subjected to shear. This permits the mud to entrain and suspend the cuttings, sand and various other materials when the mud is at rest, or subjected to slight shear. At the same time, when the mud is subjected to shearing forces as in pumping, the viscosity is reduced sufficiently to facilitate pumping; and, on encounter with the high shearing forces at the drill bit, the viscosity of the mud is reduced sufficiently to provide improved lubrication of the bit. The requisite thixotropy, notably gel strength and viscosity, is supplied by the addition of hydratable clay or colloidal clay bodies such as bentonite or fullers earth to the mud. Over a finite period of time the clay can become hydrated to increase the viscosity and gel strength of the mud. After complete hydration of the clay constituents of a mud, additional water decreases the viscosity and gel strength of the mud.

The rheological, or flow properties, of a mud invariably change during use, especially viscosity and gel strength. This is due to the nature of the clays, e.g., bentonite, which are readily hydrated during use and which, when hydrated up to the point of maximum hydration of the clay constituents, the viscosity and gel strength of the mud is increased. Generally, the clay constituent, or constituents, of a mud gradually absorb or adsorb water and the viscosity and gel strength of the mud is increased. The acceptable range of viscosity and gel strength which a mud can possess, however, is limited, and it cannot be permitted to become too thin or too thick. When a mud becomes too thick, it must be thinned and brought back into an acceptable range of viscosity and gel strength.

During drilling operations, various conditions often cause undesired changes in the thixotropic properties of a mud, this making it necessary to constantly treat the mud to maintain the desired thixotropy, viscosity and gel strength. For example, certain formations such as encountered in the Gulf Coast areas of the United States and other areas of the world contain considerable concentrations of mud-making clays or minerals, such as montmorillonite, which tend to swell on hydration or absorption of water from the drilling mud, this increasing the viscosity and gel strength of the drilling mud.

These changes in the thixotropic properties of muds, notably increased viscosity and gel strength, necessitate continued costly reformulations of the drilling mud, especially constant thinning which calls for the addition of additives to the mud. Such additives, while serving to control a specific property as all too well known, often produce undesirable side effects as relates to other physical and chemical properties of the mud. Reformulations thus not only require constant quality control, which is costly, but additions to the mud all too soon adversely affect the overall properties of this mud so that it must be replaced. Replacement, in itself, is not only costly but creates disposal problems which, under recent EPA regulations, can in itself prove troublesome.

It is accordingly the prime objective of the present invention to provide a novel process, and apparatus, for restoring the rheological properties of a drilling mud, especially by providing means for reducing the viscosity and gel strength of such muds without the use of additives.

A more specific object is to provide process and apparatus useful at drilling sites for providing a rapid reduction of viscosity and gel strength of a thixotropic mud without change of its chemical composition, and without significant change in the density of the mud.

These and other objects are accomplished in accordance with the present invention which generally comprises:

(i) a process for reducing the viscosity and gel strength of a hydratable clay-containing drilling fluid, or mud, by contacting said drilling fluid, or mud, with an inclined surface revolving, or otherwise moving, at a rate sufficient to impart adequate compression or sheer force, or both compression and sheer forces, to dewater the hydrated clay constituent, or constituents, of said drilling fluid, or mud; and (ii) an apparatus, or inertial device, preferably one constituted generally of structure inclusive of a revolvable cone within the inner surface of which a stream or spray of said hydratable clay-containing drilling fluid, or mud, can be impinged or contacted, when the cone is revolved at sufficient speed, to impart adequate compression or sheer force, or both compression and sheer forces, to dewater the hydrated clay constituent, or constituents, thereby reducing the viscosity and gel strength of the drilling fluid, or mud.

It has been found that the viscosity and gel strength of a drilling fluid, or mud, which contains a hydratable clay constituent, or constituents, which has been rendered highly viscous and of high gel strength by adsorption or absorption of water by the hydratable clay can be drastically reduced by impinging or contacting a stream, or jet, of said drilling fluid, or mud, upon a moving, inclined surface. In its preferred aspects, the inclined surface is cone shaped, the smaller end of the cone is closed, the larger end of the cone is open, and the cone is rotated at speed sufficient to impart an adequate compression force to dewater the hydrated clay-containing constituent, or constituents, of the mud. In a more preferred aspect, the large end of the cone is also partially closed by a non-moving wall, or baffle, which exerts an added sheer force on the mud which is expressed from the large open end, or mouth, of the revolving cone.

The small diameter end of the cone can be of full cone shape, or of frusto-conic shape, but is generally the latter and ranges from about 1 to about 3 inches in diameter. The large open end of the cone can be of virtually any diameter, but generally ranges up to about 18 inches in diameter, with preferred diameters ranging from about 9 inches to about 15 inches. The cone can be rotated at virtually any velocity sufficient to impart the compression force required to dewater the hydrated clay constituent, or constituents, of a mud. Practical speeds of revolution of the cone generally range from about 400 rpm (revolutions per minute) to about 6000 rpm for cones whose largest diameter ranges to about 18 inches. Since the compression force exerted on a hydrated clay particle injected into the small end of a cone is increased as the particle moves toward the open large diameter side of a cone it follows, of course, that the smaller diameter cones require higher rates of revolution than the larger diameter cones. Preferably, a combination of cone size and cone speed is employed to accelerate a hydrated clay particle at the small end of the cone at a rate of about 35 feet per second, each second, up to about 500 feet per second, each second, and more preferably from about 35 feet per second, each second, to about 180 feet per second, each second, at the large open end, or mouth, of the cone. Such particle acceleration can be imparted, e.g., by use of a frusto-conic shaped cone having a diameter at its smaller closed end of $2\frac{1}{4}$ inches and a diameter at its larger open end of $11\frac{3}{4}$ inches by rotating the cone at a speed of 3500 rpm.

In use, the stream of drilling fluid, or mud, is injected directly into the bottom or closed end of the cone, preferably in a path coincident or parallel with the central axis through the center of the cone. The drilling fluid, or mud, is projected or thrown against the rotating inclined surface, the surface of the cone forming an angle of inclination ranging from about 20° to about 60°, preferably from about 30° to about 45°, as measured by the angle formed between the central axis of the cone, or the path of the projected drilling fluid, or mud, and the rotating surface. The surface of the cone is rotated at linear velocities ranging, at the large diameter side of the cone about 180 feet per second, and higher, preferably from about 180 to about 500 feet per second which is sufficient to adequately dewater most clays and lower the viscosity and gel strength of the mud by producing substantial separation of water from the particulate hydrated clays on contact of the drilling fluid, or mud, with the moving, inclined surface. On separation of the water from the clay, the drilling fluid, or mud, is constituted of an admixture which includes gel, solids particles and water, or such admixture which obtains gel, solids particles and an increased amount of water released from the clay of the drilling fluid, or mud, whose viscosity and gel strength are reduced. Rehydration of the clay with water can be suppressed by continuous recirculation of the mud through the cone, the time between contacts being frequent enough not to allow time for rehydration; or, an additive, e.g., lignosulfonate or another type of thinner, can be added to suppress rehydration of the clay.

In a preferred apparatus embodiment, a cone is mounted with its smaller end closed on a revolvable shaft, and an inlet through which a stream of a hydratable clay-containing drilling fluid, or mud, can be directed into the large open end, or mouth, of the rotating cone such that, when the cone is rotated at sufficient angular velocity, the hydrated clay of the drilling fluid, or mud, is dehydrated by compression and an admixture comprising gel, solid particles and water is expressed from the edges around the mouth of the cone, and the viscosity and gel strength of the expressed drilling fluid, or mud, is drastically reduced as contrasted with the drilling fluid, or mud, prior to such treatment. Preferably, the cone provides an inner surface having an angle of inclination from a central axis through the center thereof ranging from about 20° to about 60°, preferably from about 30° to about 45°. This means, in effect, that the total included angle formed by opposed surfaces within the mouth of the cone ranges from about 40° to about 120°, preferably from about 60° to about 90°. The cone is generally revolved at speeds ranging from about 400 to about 6000 rpm, preferably from about 2500 to about 4500 rpm, such speeds generally being sufficient to inertially separate the water from the hydrated clays of the drilling fluid, or mud, thereby reducing its viscosity and gel strength.

Having reduced the viscosity and gel strength, gel reformation can be avoided by various known methods. Whereas the separation of water from the hydrated clays can be effected without any need for additives, some selected additives can be added, if desired, to directly inhibit or suppress reformation of the gel, or combine with the excess water to prevent reformation of the gel. Or, on the other hand, the water can be recirculated and again contacted with the cone, or physically separated from the admixture before the clay and water have had time to reform a gel.

The invention, including both the process and apparatus, and the principle of operation,, will be more fully understood by reference to the following detailed description of a preferred embodiment, and to the attached drawing to which reference is made as the description unfolds. Similar numbers are used to represent similar parts or components in the figure.

Referring to FIG. 1, there is described a preferred apparatus comprising an inertial device, or centrifuge, within which the mud is treated for viscosity and gel strength reduction, the centrifuge being included as part and parcel of a mud-containing tank within which all or a portion of the treated mud can be temporarily stored. The overall combination, referred to as a recycling centrifuge system, is described by the reference numeral 10. The system 10 is comprised generally of a relatively small centrifuge 11 which is driven by an electric motor 12, both components of which are mounted atop a sludge tank 13 within which all or some portion of the treated mud can be stored. The system 10 also includes an electric pump 14 driven by a motor 15 which is used to pump the mud from the tank 13 via line 17, or to recycle all or some portion of the mud contents for additional treatment in the centrifuge 11. Thus, the inlet side of the pump 14 is connected to the sludge tank 13 via line 16 and suction line 17, and the outlet side of the pump 14 is connected to centrifuge 11 by a discharge hose 19. Hand valves 18,20 are optionally provided to open or close off the recycle circuit from the tank 13, or to control the amount of mud flow to centrifuge 11. Optionally, also, water may be injected into centrifuge 11 for in some instances it may increase the efficiency of the treatment. In such embodiment, the water is supplied via line 21, while mud is supplied via line 19, the water supplied via line 21 being introduced with the mud into centrifuge 11.

In an alternate embodiment, motor 15 and pump 14 can be located adjacent centrifuge 11, and line 16 can be located directly within the mud within sludge tank 13.

In the overall operation, as generally described by reference to FIG. 1, valves 18, 20 and 22 are opened and motor 15 causes pump 14 to suck mud from tank 13 through lines 17,16 to force the mud through line 19 into the centrifuge 11 where, if desired, it can be mixed with water added via line 21. Motor 12 operates centrifuge 11 which treats the mud to reduce its viscosity and gel strength whereupon the treated mud is then discharged as a stream 24 via line 23 into the tank 13.

The centrifuge 11, which constitutes the heart of the system, is described by direct reference to FIG. 2. The centrifuge 11 is comprised of a cone 29, axially and rotatably mounted upon a shaft, or axle 27, which is journalled within the opposed end walls 30,43 of a cylindrical vessel 26. The smaller end of the cone 29 is closed upon the axle 27, forming an enclosed bottom for the cone, and the large open end thereof is concentric with and diverges outwardly from said axle 27 providing an open mouth within which the terminal end of lines 19,21 are partially extended via projection through the upper side of the wall, or baffle 34, and openings within the enclosing rearward inner wall 36 of cylinder 26. The inner rearward wall 36, formed end wall 43, and the enclosing side wall 37 provide an enclosed chamber 32 within which mud inlet lines 19, and optionally water inlet line 21, are extended. An outlet from the chamber is provided by a line, or port 23, which leads into tank 13. The mouth of the cone 29 is further partially enclosed by means of the baffle 34, providing a conical chamber 35 into which the terminal ends of lines 19,21 are extended; and an exit feature for the treated mud, or treated mud and water, is provided to the chamber 32 via the annular opening 40 which extends peripherally around the circumferential edge of the cone 29, or conical chamber 35. The baffle 34 is non-rotating and can be supported, or affixed, on the inner rearward wall 36 by studs, or webbing (not shown). The shaft 27 is sealed within the end walls 30,43 via seals 41,42 and an end 28 of the shaft 27 is affixed to motor 12 by virtue of which it, and cone 29, can be rotated.

In a preferred option, the axle 27 can be hollow and used as an additional, secondary or substitute conduit for emptying the chamber 32. This use may be desirable, for example, in the event that line 23 should be plugged, or if it may be desirable to restrict or close off flow through line 23 via closure or partial closure of valve 38. Use of such alternate conduit through axle 27 might thus be desirable if the chamber 32 is designed sufficiently large, or if the flow of mud 19 into the chamber 32 is sufficiently slow relative to the size of the chamber 32, that some stratification of the mud occurs after viscosity and gel strength reduction has been reduced by contact of the mud with revolving cone 29.

The axle 27 can be provided with an opening or perforations 39 opening into the passageway 44 through the axle 27. The end of the passageway 44 wherein the axle 27 is adjoined to the motor 12 is provided with a seal, or plug 45, and the opposite end of the passageway 44 is provided with a valve 46 which, if desired, can be designed to open automatically should the pressure in chamber 32 become excessive.

In the operation of the recycle centrifuge system, mud from tank 13 is injected or passed via line 19, and optionally water from an external source is passed via line 21 into cone chamber 35 where it impinges upon the rapidly revolving surface provided by the cone 29, the cone spilling over with the mud which is expressed from the mouth of the cone, and subjected to sheer forces by flowing over the peripheral edges of the cone, via passageways 40,31 rearwardly into the chamber 32. The mud which exits from the chamber 32, and flows into tank 13, is found to be of lower viscosity and gel strength than the viscosity and gel strength of the mud which enters into the centrifuge 11 via line 19. The viscosity and gel strength of the mud is reduced within the cone by compression and sheer forces, sufficient energy being imparted to the hydrated clay of the mud by the rapidly revolving surface of cone 29, and impingement upon baffle 34 to substantially dewater the clay and thus produce separation of at least some of its waters of hydration.

It is apparent that various modifications and changes can be made without departing the spirit and scope of the present invention. For example, as relates to apparatus, changes can be made in the size, shape and relative dimensions, and various construction materials can be used. The mouth of the cone can be varied over a range of angles, or the angle of incidence of the injected stream of mud can be changed; the cone can be revolved at different speeds, and the velocity of the mud jet itself can be varied to some extent to impart the desired energy to the mud particles brought into contact with the cone therewith without departing the spirit and scope of the invention.

Having described the invention, what is claimed is:

1. A process for reducing the viscosity and gel strength of a hydratable clay containing drilling mud which comprises contacting said mud with the inner surface of a revolving cone, the total included angle of the cone ranging from about 40° to about 120°, the cone revolving at a speed ranging from about 400 to about 6000 revolutions per minute, sufficient to impart adequate compression force to dewater the hydrated clay constituent and thereby reduce the viscosity and gel strength of said mud.

2. The process of claim 1 wherein the total included angle of the inner surface of the revolving cone ranges from about 60° to about 90°.

3. An apparatus for reducing the viscosity and gel strength of a hydratable clay containing drilling mud which comprises a cone provided with a small end and a large open end, the small end of the cone is enclosed and affixed upon an axle the central axis of which is common with the central axis of the axle, and the axle is journalled within the alternately disposed walls of a housing, the wall of the cone defining an inner surface which diverges to provide an included angle ranging from about 40° to about 120°, a motor operatively engaged to the axle for rotation of said axle and cone, a mud supply line aligned upon the inner surface within the large open end of the cone whereby a stream of mud can be injected into the inner surface of the cone, and wherein the large open end of the cone is provided with a baffle of slightly less diameter than the diameter of the large open end of the cone and the mud supply line is extended through said baffle into the large open end of the cone, the housing is provided with enclosing walls defining an enclosed chamber, the chamber is provided with an outlet which is communicated with a mud collection tank, a recycle line communicates the tank with the mud supply line, and the motor recycles all or a portion of the mud from the tank through the mud inlet line to the large open end of the cone, whereby mud of reduced viscosity and gel strength can be discharged from the large open end revolving cone via the annular opening between the baffle and large open end of the cone into the chamber formed within the housing, and then discharged via the outlet from the chamber into the mud collection tank.

4. In apparatus for reducing the viscosity and gel strength of a hydratable clay containing drilling mud, the combination which comprises a recycling centrifuge which includes a vessel provided with an enclosing side wall and end walls, a cone provided with a small end and a large open end, the large end of the cone having an inner surface which diverges to provide an included angle ranging from about 40° to about 120°, the small end of which is affixed upon an axle the central axis of which is in common alignment with the central axis of said cone, and the axle is journalled in the alternately disposed end walls of said vessel, a mud supply line extending through an end wall of said vessel and aligned upon the inner surface within the large open end of the cone for delivery and injection of said drilling mud into the inner surface of said cone, motor means for rotating said cone at a rate ranging from about 400 to about 6000 revolutions per minute sufficient to impart adequate centrifugal force and impact to dewater the hydrated clay constituent and thereby reduce the viscosity and gel strength of the mud, an outlet in a wall of said vessel for the discharge of a drilling mud from the revolving cone after impact therewith whereby the viscosity and gel strength of the mud are reduced, a tank provided with enclosing side wall and bottom within which drilling mud can be contained, and atop which said recycling centrifuge is mounted, said tank including a mud supply conduit extending from the bottom of said tank, and a pump to the inlet side of which said mud supply conduit from the bottom of said tank is connected, the outlet side of said pump being connected to the mud supply line which is extended through an end wall of said vessel of the recycling centrifuge whereby drilling mud can be pumped from the bottom of said tank to the cone of the recycling centrifuge and the hydrated clay constituent dewatered to reduce the viscosity and gel strength of the mud, and the mud then discharged from the recycling centrifuge into the tank.

5. The apparatus of claim 4 wherein the total included angle formed by the opposed surfaces within the mouth of the cone ranges from about 60° to about 90°.

6. The apparatus of claim 4 wherein the large open end of the cone ranges up to about 18 inches in diameter.

7. The apparatus of claim 4 wherein the open end of the cone is provided with a baffle of slightly less diameter than the diameter of the open end of the cone, the large open end of the cone ranges up to about 18 inches in diameter, and the mud inlet line is extended through said baffle.

8. The apparatus of claim 7 wherein the diameter of the large open end of the cone ranges from about 9 inches to about 15 inches in diameter, and the motor means is capable of driving the cone at speeds of from about 2500 rpm to about 4500 rpm.

* * * * *